US005085067A

United States Patent [19]

Reismann et al.

[11] Patent Number: 5,085,067

[45] Date of Patent: Feb. 4, 1992

[54] METHOD AND ARRANGEMENT FOR AUTOMATICALLY ALIGNING A UNIVERSAL ROLLING MILL STAND AFTER THE STAND HAS BEEN CHANGED TO NEW TYPES OF SECTIONS

[75] Inventors: Hans-Jürgen Reismann, Duesseldorf; Burkhardt Poreombka, Grevenbroich; Walter Schmalz, Erkrath, all of Fed. Rep. of Germany

[73] Assignee: SMS Schloemann-Siemag Aktiengesellschaft, Dusseldorf, Fed. Rep. of Germany

[21] Appl. No.: 675,187

[22] Filed: Mar. 26, 1991

Related U.S. Application Data

[62] Division of Ser. No. 528,696, May 14, 1990.

[30] Foreign Application Priority Data

May 24, 1989 [DE] Fed. Rep. of Germany ..... 3916925
May 24, 1989 [DE] Fed. Rep. of Germany ..... 3916927

[51] Int. Cl.[5] ..... B21B 13/08; B21B 31/16

[52] U.S. Cl. ..... 72/20; 72/21; 72/225; 72/247

[58] Field of Search ..... 72/20, 21, 775, 237, 72/238, 247, 365.2, 366.2

[56] References Cited

U.S. PATENT DOCUMENTS 3,968,672 7/1976 Kamogawa et al. ..... 72/225
4,127,997 12/1978 Quehen ..... 72/225
4,702,099 10/1987 Sturm ..... 72/225
4,787,226 11/1988 Haynes ..... 72/225
4,918,964 4/1990 Engel et al. ..... 72/225

FOREIGN PATENT DOCUMENTS 0329999 8/1989 European Pat. Off. ..... 72/225

*Primary Examiner*—Lowell A. Larson
*Assistant Examiner*—Thomas C. Schoeffler
*Attorney, Agent, or Firm*—Toren, McGeady & Associates

[57] ABSTRACT

A method and an arrangement for automatically aligning horizontal rolls and vertical rolls in a universal rolling mill stand after the stand has been changed to new types of sections in a rolling mill train. The axial geometric configuration of the vertical rolls in the stand serve as a fixed reference value and the horizontal rolls are displaced radially and axially into roll positions which are measured by actual position indicators and from which the geometric roll gap center and the geometric roll center in the stand are determined. For taking into consideration the spring characteristic constants of the stand, the radial spring characteristic for the two horizontal rolls is determined together, the radial spring characteristic for each vertical roll is determined separately and the axial spring characteristic of one of the horizontal rolls is determined separately in accordance with one of the two axial directions. The rolls are moved towards each other electromechanically until a moment of contact and subsequently the roll body pressure is hydraulically increased to at least two pressure points and then the roll body pressure is relieved from the pressure points.

6 Claims, 7 Drawing Sheets

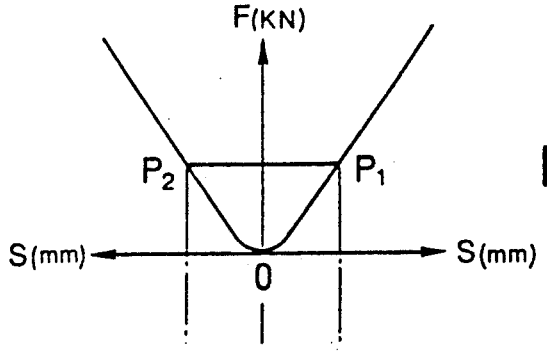
FIG.2
FIG.1
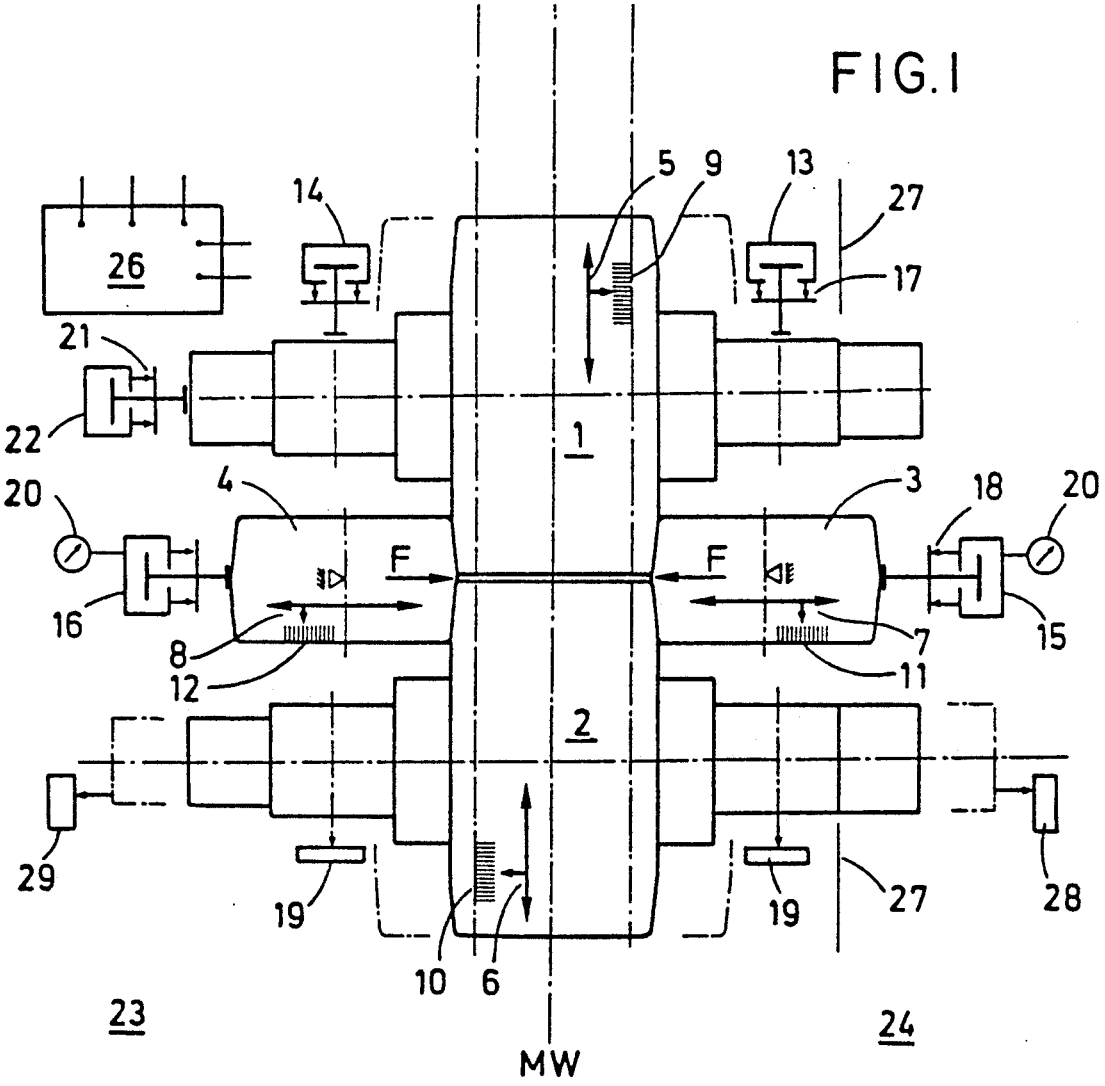

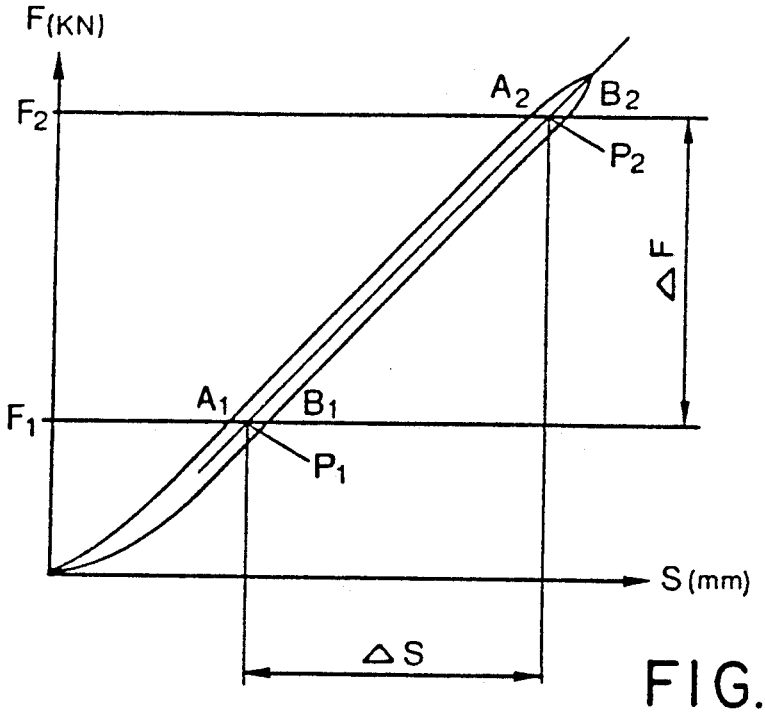
FIG.5A
FIG.5B
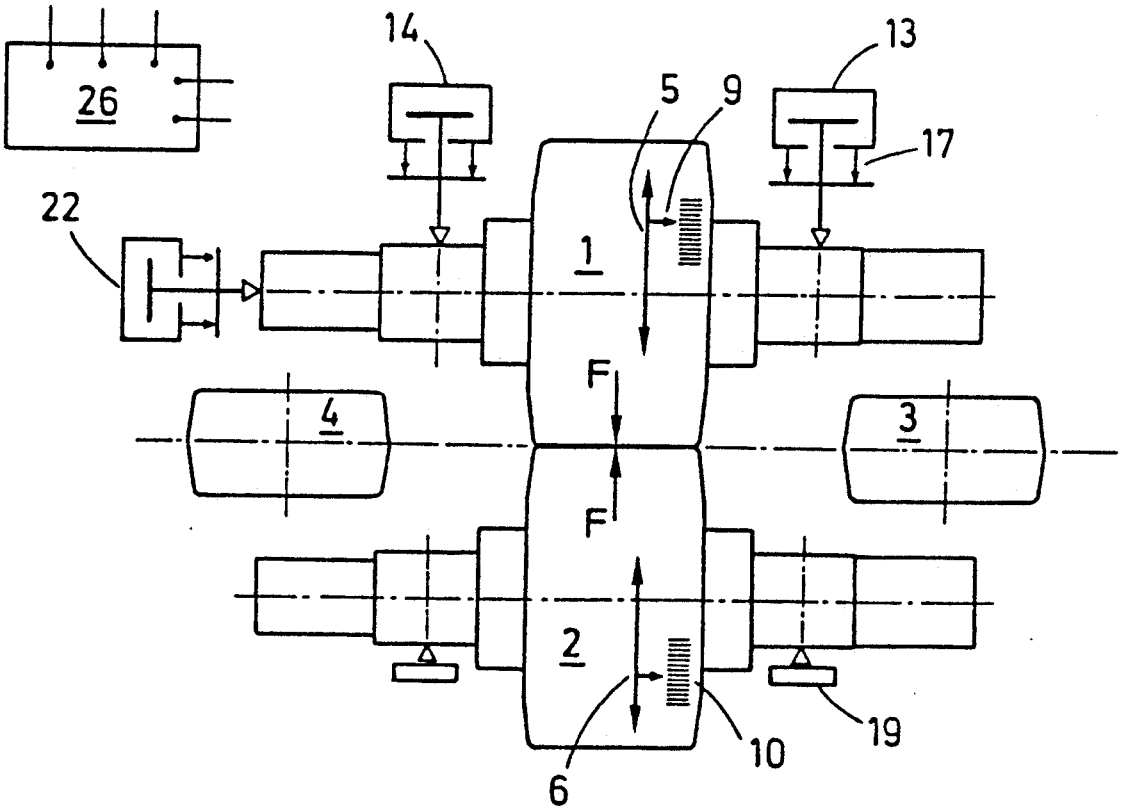

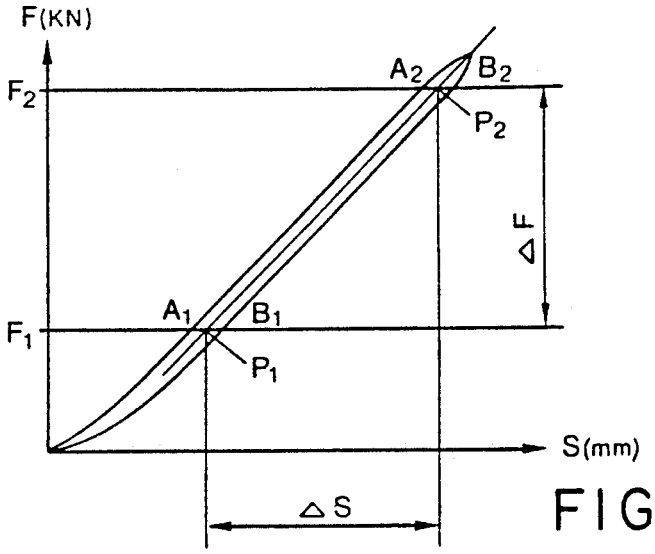
FIG.7A
FIG.7B
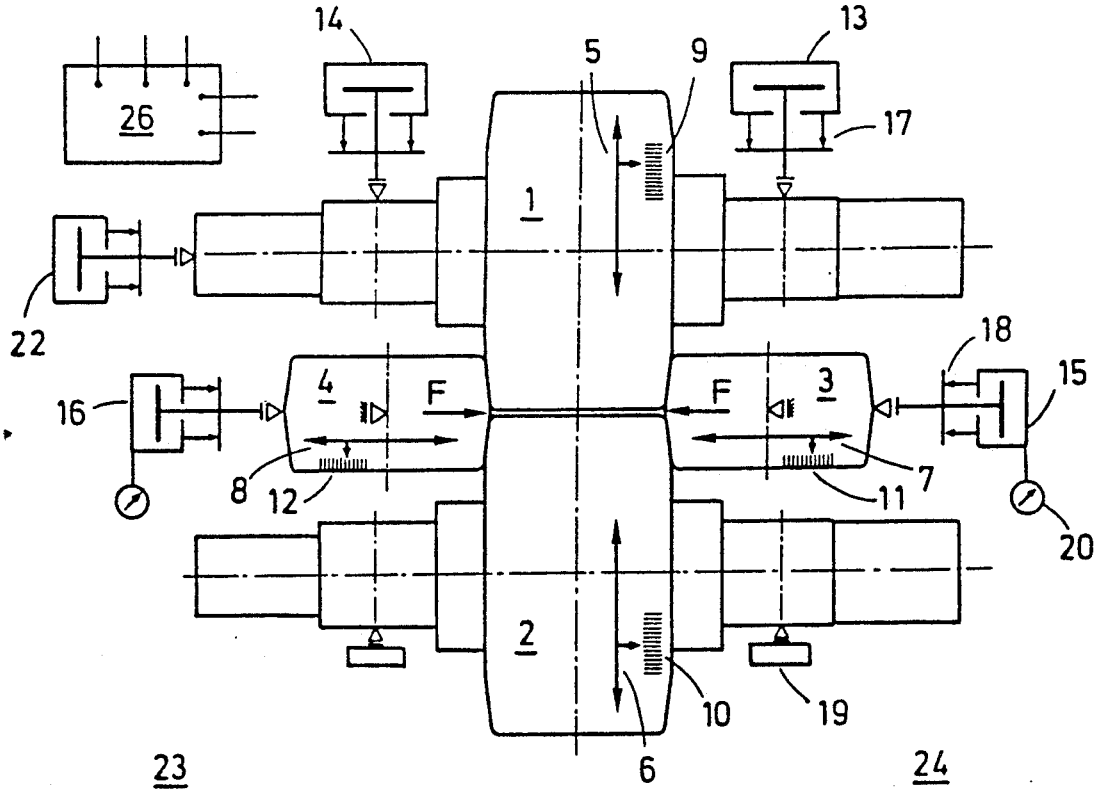

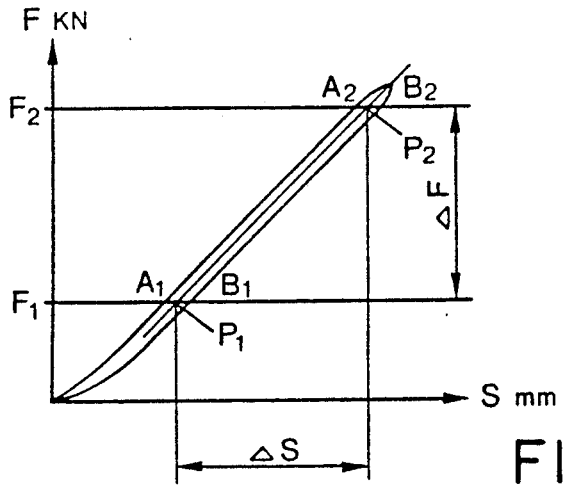
FIG.8A
FIG.8B
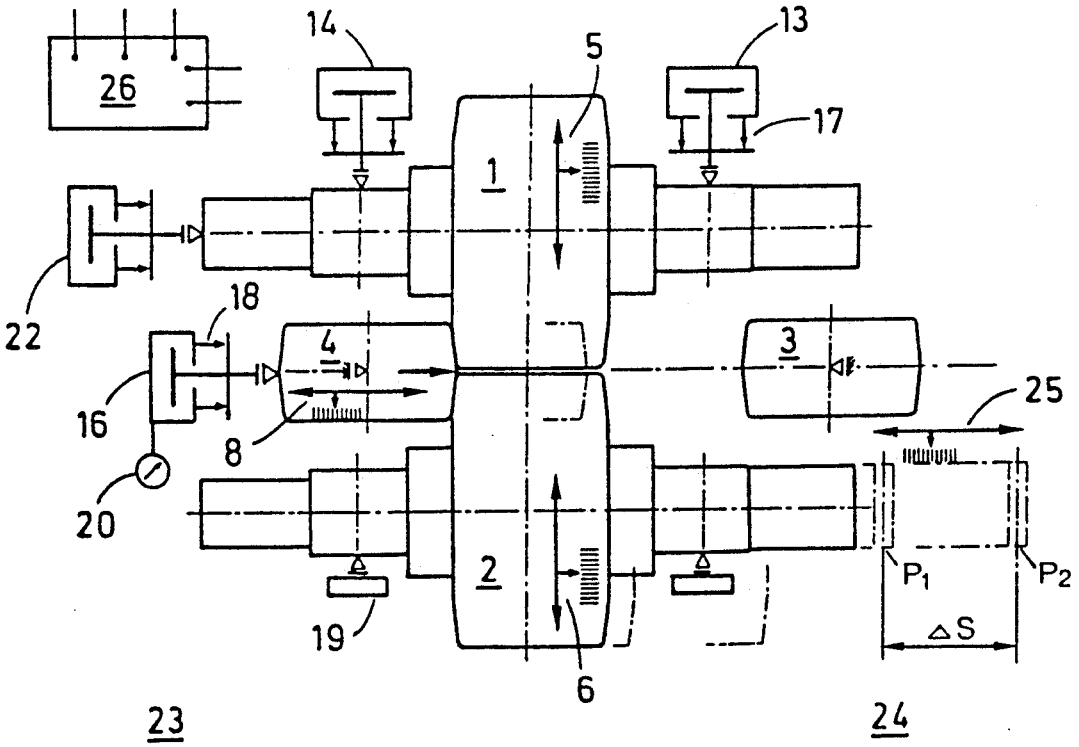

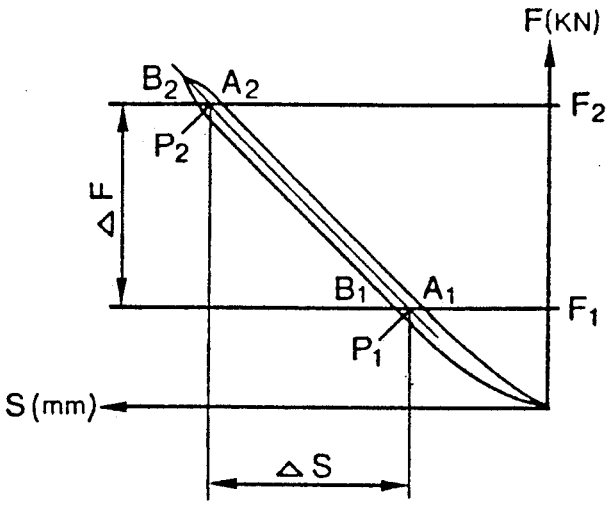
FIG.9A
FIG.9B
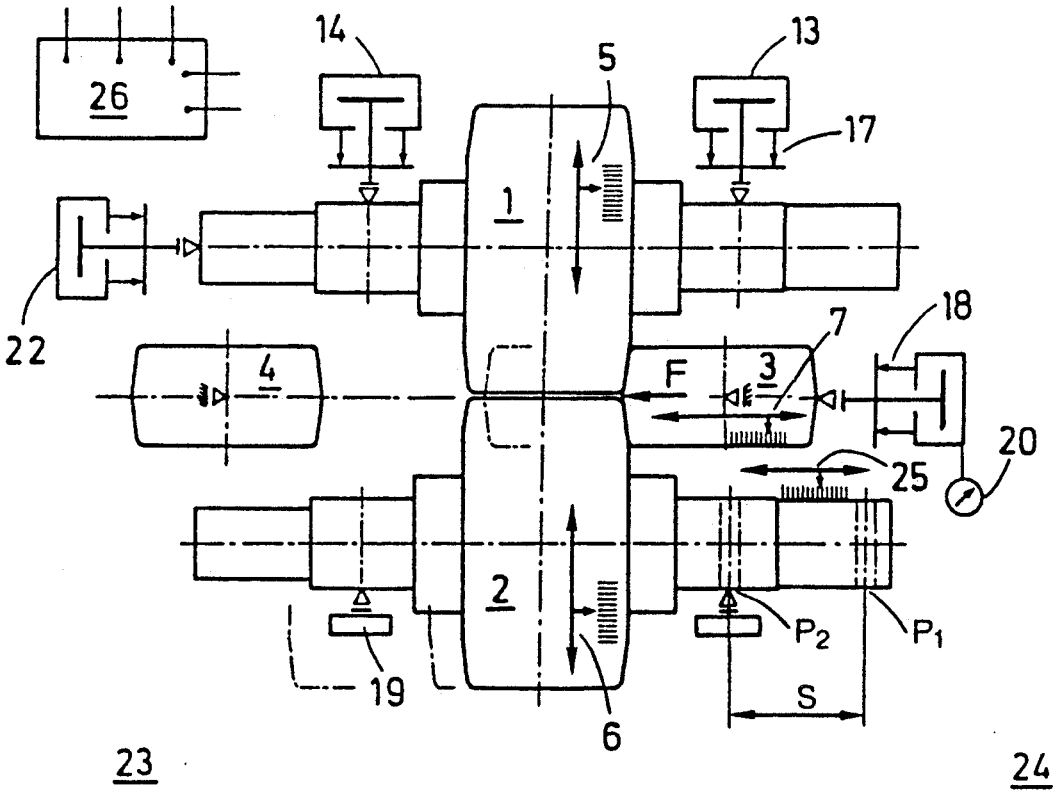

METHOD AND ARRANGEMENT FOR AUTOMATICALLY ALIGNING A UNIVERSAL ROLLING MILL STAND AFTER THE STAND HAS BEEN CHANGED TO NEW TYPES OF SECTIONS

This is a division of application Ser. No. 07/528,696, filed May 14, 1990.

BACKGROUND OF THE INVENTION

1. Field of the Invention

The present invention relates to a method for automatically aligning horizontal rolls and vertical rolls in a universal rolling mill stand, particularly after the stand has been changed or converted to new types of sections in the rolling mill train. The alignment is effected by means of adjusting members and by means of position measuring devices for the roll adjustments which are connected to computing units and particularly take into consideration the spring characteristic constant. The invention also relates to an arrangement for carrying out this method.

2. Description of the Related Art

A method of the above-described type for the automatic alignment of the rolls of a universal rolling mill stand is described, for example, in German patent 35 01 622. In this known method, the lower roll is moved to the roll middle and the upper roll is moved with rolling pressure to the lower roll. By moving the rolls together, the respective positions of the rolls are determined, wherein the position of the lower roll in the roll middle is used as the initial value. The further method steps are oriented with respect to the lower roll aligned in this manner. In other words, the upper roll and the vertical roll are aligned relative to the lower roll in such a way that the axial fastening of the upper roll is released and the vertical rolls are moved in the direction towards the roll middle, whereby the vertical rolls may rest against a side of the upper roll and may axially displace the upper roll until both vertical rolls rest against the sides of the lower roll. The upper roll is then fixed in this position. All rolls are then subjected to rolling pressure and the system is set to zero in the connected computer. This known method for aligning the rolls does not take into account that the springiness of the stand in radial direction of the horizontal rolls and the springiness of the stand in radial direction of the vertical rolls may be very different. For this reason, the known alignment of the rolls is subjected to substantial inaccuracies which at the latest become a disadvantage when the stand begins to operate with the first sectional material to be rolled and the roll pressures are applied.

European patent application 0 248 605 describes a method for aligning the vertical rolls and the horizontal rolls of a universal rolling mill stand, wherein initially the upper horizontal roll is moved into a predetermined initial position in the roll gap middle and the two vertical rolls are moved against the sides of the upper horizontal roll in order to determine the initial position of the upper horizontal roll. Subsequently, the vertical rolls are moved back and the lower horizontal roll is moved against the upper horizontal roll in order to determine an initial position for the lower horizontal roll. Finally, the two vertical rolls are moved against the sides of the upper horizontal roll and of the lower horizontal roll. If the edges of the horizontal rolls are not in alignment after the above-described alignment has been carried out, the axial locking of one of the horizontal rolls is released and this horizontal roll is moved by the vertical rolls towards the aligned edge position. This European patent does not provide any indication with respect to the need for determining the springiness of the stand with respect to the horizontal rolls and the vertical rolls simultaneously with the alignment of the rolls, so that the geometric coordinates of the stand are reproducibly determined with respect to the rolled material or the rolled section. The European patent application does mention a coarse adjustment for the vertical rolls and an AGC-cylinder, however, the above-described necessity of a separate spring characteristic determination is not mentioned.

German Offenlegungsschrift 38 01 466 describes an adjusting device for a universal stand with electromechanical coarse adjustments and hydraulic fine adjustments for the roll. The adjusting device carries out a calibration process for the stand in time intervals. For this purpose, all rolls are electromechanically moved toward each other to reach zero pass and, subsequently, different average hydraulic pressures to be expected in accordance with the pass schedule are adjusted. All stored hydraulic pressures in the different position values of the fine adjustments result in the stand spring characteristic for the vertical and horizontal force pattern. The position and pressure values adjusted under calibrating conditions are set at zero value. The above-described measures make it possible satisfactorily to carry out the pass adjustments, particularly of the finishing stand in a universal beam rolling mill, without requiring a test run and a test bar.

The above-described known methods for aligning the rolls of a universal stand have the disadvantage that the roll positions determined in this manner in the stand cannot meet the practical requirements because, for example, in asymmetric sections, the determined vertical middle of the roll body is not identical with the shape of the pass. This necessarily results in unequal roll forces.

SUMMARY OF THE INVENTION

It is, therefore, the primary object of the present invention to provide a method for automatically adjusting the horizontal rolls and the vertical rolls of the universal stand, particularly after the stand has been reassembled for new section shapes, to a geometric configuration of the assembly relative to the center of the rolling mill stand, particularly in connection with an automatic determination of the spring characteristics of the stand, i.e., with respect to the support expansions, the elastic behavior of the rolls used and the roll adjustments and the like. After the automatic adjustment of the rolls, the rolling forces should act uniformly on the rolled section material, even if the rolled material is very asymmetrical. It is also an object of the present invention to provide an arrangement for carrying out the above-described method.

In accordance with the present invention, the axial geometric configuration of the vertical rolls in the stand serves as a fixed reference value, wherein the horizontal rolls are displaced radially and axially into such roll adjustments measured by actual position indicators from which the geometric roll gap center and the geometric roll center in the stand are determined.

The method according to the present invention for automatically adjusting horizontal rolls and vertical rolls in a universal stand has the following advantages. Starting from the vertically determined geometric configuration of the vertical rolls in relation to the stand, the assembly of the horizontal rolls is exclusively determined by the geometric configuration of the roll stand, so that the web center of a new section, i.e., the roll gap center, can be placed exactly into the center of the vertical roll body. The method step according to the invention according to which the horizontal rolls can assume an axial center position which corresponds to the axial stand center ensures that the flange thickness of a new section can be adjusted exactly on the operator side of the stand as well as on the drive side of the stand. This results in rolled sections having no significant eccentricities of the webs and having accurate flange thicknesses and web thicknesses. It should be emphasized that test runs with one or more test sections are unnecessary because the roll pass is adjusted automatically to the optimum pass by taking into consideration all rolling conditions from the beginning for each section bar being rolled.

In accordance with a preferred development of the invention, the automatic adjustment of the rolls in the universal stand is carried out by the following sequence of method steps. The vertical rolls are mounted in the stand so as to be undisplaceable in vertical direction of the stand and at the same vertical level in a horizontal plane. The lower horizontal roll is mounted in a vertical center position of the stand. Subsequently, the lower horizontal roll is alternately driven by the vertical rolls with a certain pressure and the roll center is determined by the measured position values. The horizontal rolls are then moved and a certain roll gap is adjusted above the horizontal center position of the vertical rolls. The vertical rolls are then moved against the lower horizontal roll and a certain pressure is applied to the vertical rolls. Subsequently, the upper horizontal roll is moved alternately against the vertical rolls, the positions obtained are measured and the distance of the lower horizontal roll from the roll gap center is computed. Finally, all actual position indicators for the horizontal rolls and the actual position indicators for the vertical rolls are set at zero. This is done taking into consideration the previously adjusted roll gap and the profile of the roll body and the determined measurement value; it is ensured that the upper roll and the lower roll have the same profile of the roll body. The above-described sequence can also be started with the upper horizontal roll. Also, the roll gap of the horizontal rolls which have been moved may be below the horizontal center position of the vertical roll.

The above-described sequence of method steps makes it possible to determine fully automatically and without any test run and without any optical auxiliary means the exact geometric roll center and roll gap center relative to the stand. The adjustment of the rolls in the stand can be carried out and regulated from an operator position. Thus, for determining the axial roll center of the stand which coincides with the axial roll center of the horizontal rolls, merely the vertical rolls are moved in horizontal direction and the exact radial adjustment of the horizontal rolls is initially not significant. The roll gap center of the horizontal rolls is determined only in the second automatically conducted method step.

Another feature of the present invention provides that the radial spring characteristic for the two horizontal rolls is determined together, the radial spring characteristic for each vertical roll is determined separately and the axial spring characteristic of one of the horizontal rolls is determined separately in accordance with one of the two axial directions. This is being done by moving the rolls electromechanically toward each other until the moment of contact and subsequently increasing the roll body pressure hydraulically to at least two pressure points and then relieving the pressure points. The above-described determination of the spring characteristic makes it possible in an advantageous manner to take into consideration the axial rolling force component which always differs in a section rolling mill from section to section, wherein the axial rolling force component additionally occurs non-uniformly distributed over the upper horizontal roll and the lower horizontal roll. The advantage of the method steps of the present invention becomes even more evident in symmetrical sections because the vertical center of the roll body does not have to be identical at all with the shape of the pass. The load applications occurring in practice can be taken into consideration in the determination of the stand spring characteristics according to the present invention in order to carry out a quick and reproducible pass adjustment of the universal stand without requiring a test run and a test bar.

Another further development of the invention provides that the speed of the electromechanical adjustments of the rolls toward each other can be reduced with increasing distance reduction and becomes zero at the moment of contact. This makes possible an even quicker and safer determination of the spring characteristics when a change occurs from a rolled section to a new section because the rolls can be moved toward each other in a programmed manner until the moment of contact, i.e., the so-called rolled kissing. The moment of roll kissing can be determined by pressure sensors which register a pressure increase and which stop the adjusting movement of the rolls.

In accordance with a further development of the invention, the electromechanical adjusting movement of the horizontal rolls toward each other and with opened vertical rolls is synchronized until the moment of contact and subsequently the roll body pressure is hydraulically applied to one of the horizontal rolls. As a result, damage to the horizontal rolls is avoided in an advantageous manner even if the rolls are moved relatively quickly until the moment of contact. The roll body pressure is raised hydraulically to several pressure points only subsequently for determining the spring characteristic.

In accordance with another proposal of the invention, the vertical rolls are moved electromechanically against the sides of the horizontal rolls until the moment of contact while the upper and lower horizontal rolls are moved together without pressure and are unloaded with respect to axial movements, and subsequently the roll body pressure is applied hydraulically in a pressure-synchronized manner to each individual vertical roll. For example, the upper horizontal roll can be pressed toward the lower horizontal roll with the sides at the same axial level and vice-versa. The method according to the invention makes it possible to determine the true spring characteristic constant for each vertical roll because the support forces over the horizontal rolls cancel each other and only the spring values of the stand on the drive side and on the operator side are measured.

In accordance with a special further development of the invention, a vertical roll can be moved from one side or the other side electromechanically toward the corresponding side of the lower horizontal roll or the upper horizontal roll until the moment of contact, wherein the horizontal rolls are moved toward each other without pressure and wherein subsequently the roll body pressure is hydraulically applied to each vertical roll. Simultaneously, either both horizontal rolls or one of the horizontal rolls may be fixed; also, both horizontal rolls may be axially displaceable. If necessary, the movement of the horizontal rolls can also be measured. As a result, the axial spring characteristic constant for the lower horizontal roll or the upper horizontal roll is determined separately for the operator side as well as for the drive side. In this manner, it can be taken into consideration that the lower horizontal roll or the upper horizontal roll cannot be held during rolling in the preadjusted roll center, but yields in both directions because of the differential pressure of the two vertical rolls. The resulting springiness can also be entered in the computation for adjusting the pass of the universal rolling mill stand.

A further development of the invention provides that a filling piece may be placed between the sides of the horizontal rolls and the roll body of each vertical roll before the hydraulic roll body pressure is applied to the vertical roll. This measure makes it possible to compensate different angles of the horizontal rolls and the vertical rolls, particularly when rolling sections whose flange widths may be greater than, for example, 500 mm. The filling pieces or spacer pieces have flattened portions which are taken into consideration accordingly when determining the spring characteristic constants for the vertical rolls. Such filler pieces may also be placed in between the horizontal rolls.

In accordance with another feature of the invention, the respective adjustment distance S of the hydraulic adjustment of the rolls and the corresponding roll body pressure F which is applied are measured and stored and a medium spring characteristic constant is determined from the pressure differences and the corresponding difference of the adjustment distance.

The apparatus according to the present invention for carrying out the above-described method for automatically adjusting the roll of a universal stand includes a radially acting electromechanical long-stroke adjustment means and a hydraulic short-stroke adjustment means connected to the upper horizontal roll or to the lower horizontal roll and an axially acting hydraulic short-stroke adjustment means. The lower horizontal roll or the upper horizontal roll is connected to a radially acting electromechanical long-stroke adjustment means and is releasable and adjustable in axial direction. The vertical rolls are connected to a radially acting electromechanical long-stroke adjustment means and to a hydraulic short-stroke adjustment means and are arranged on the same vertical level and undisplaceable in vertical direction of the stand. The upper horizontal roll or the lower horizontal roll has a hydraulic adjustment device for an axial movement which is capable of being unloaded. In the universal stand according to the present invention, the above-described structural features can alternately be applied to the respective other horizontal roll.

The combination of structural features of the universal stand according to the present invention makes it possible to automatically adjust the rolls in the geometric roll center and the roll gap center of the stand. The electromechanical adjustment means make it possible to carry out the so-called roll kissing quickly and very precisely. The hydraulic short-stroke adjustment means are used for reaching the adjustment distances and pressure points for determining the spring characteristics. The electromechanical long-stroke adjustment means and the hydraulic short-stroke adjustment means and also the axially acting hydraulic short-stroke adjustment means may be constructed in accordance with units known in the art.

The electromechanical long-stroke adjustment means advantageously include pressure sensors, distance indicators and the like. Pressure sensors, distance indicators and the like are also advantageously provided on the hydraulic short-stroke adjustment means. The horizontal rolls advantageously have axial actual position indicators which are measurement-technologically connected to a surface unit for determining the vertical roll center of the stand and the horizontal rolls have radial and also axial actual position indicators which are measurement-technologically connected to a computer unit for determining the horizontal roll gap center of the stand. Commercially available devices can be used for this purpose.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 1 is a schematic view of a universal stand with horizontal rolls which are positionable to the roll center and with an illustration of adjustment devices;

FIG. 2 are measurement curves for computing the roll center;

FIG. 5A is the spring characteristic for the horizontal rolls of the universal stand;

FIG. 5B shows the universal stand configured for obtaining the spring characteristic shown in FIG. 5A;

FIG. 7A is the spring characteristic for the vertical rolls;

FIG. 7B shows the universal stand configured for obtaining the spring characteristic shown in FIG. 7A;

FIG. 8A is the axial spring characteristic for the lower horizontal roll;

Figure 3:
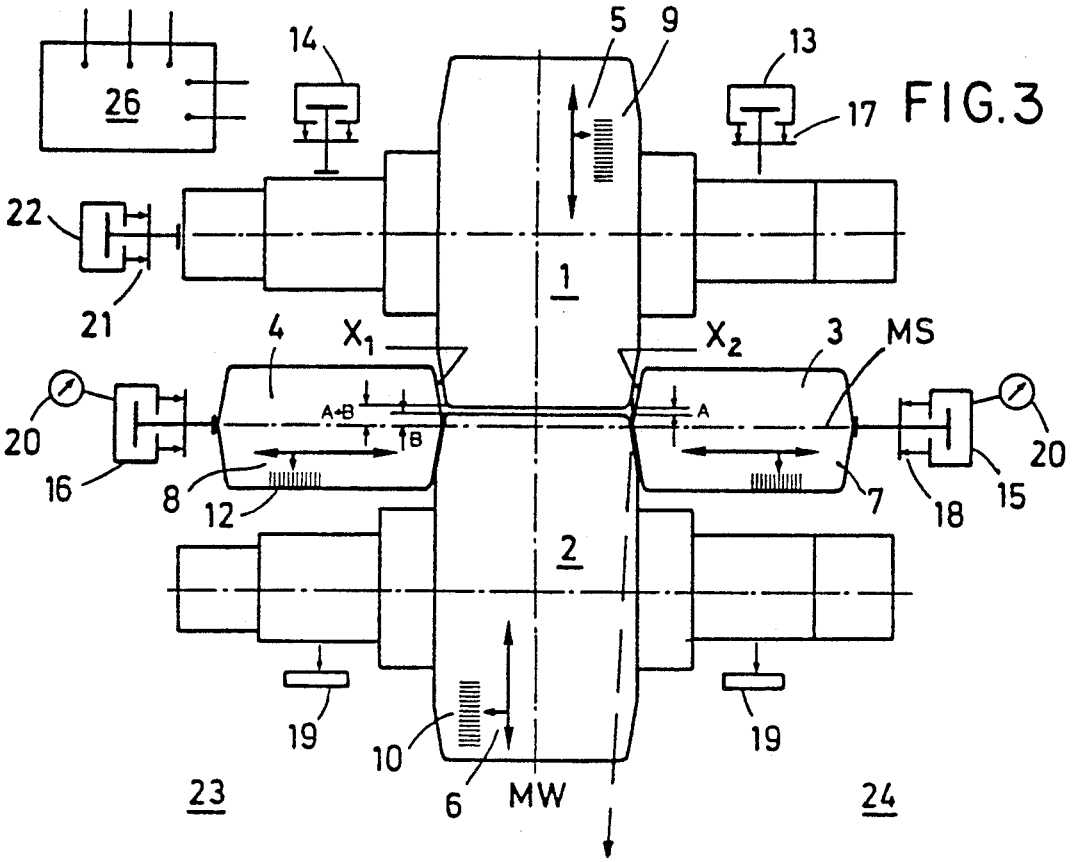
FIG. 3 is schematic view of the universal stand with horizontal rolls which are positionable to the roll gap center.
Figure 4:
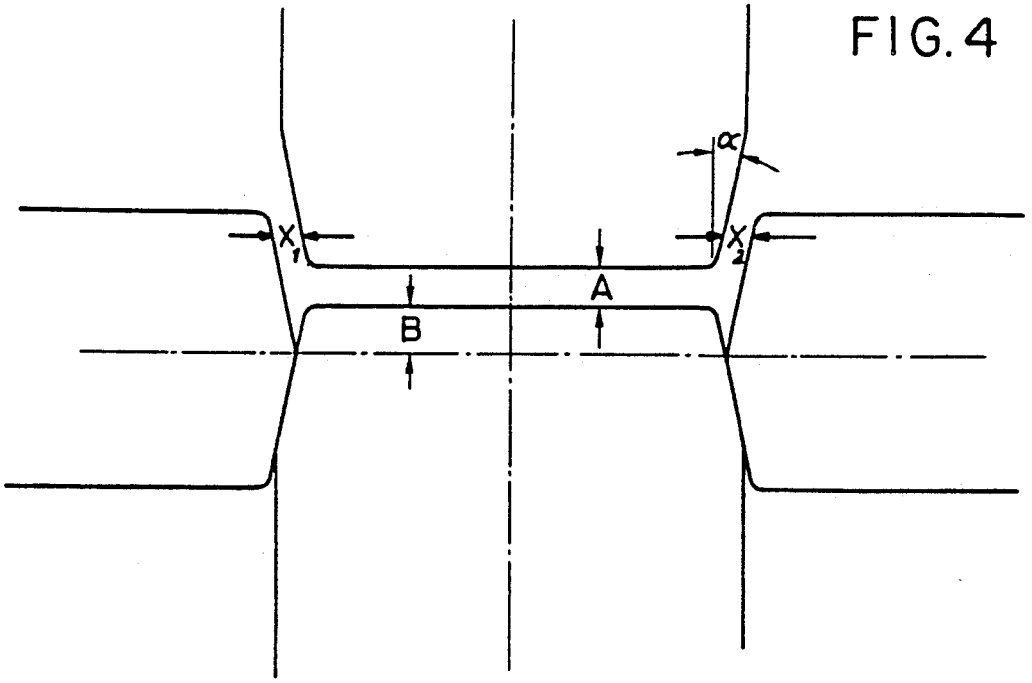
FIG. 4 shows a detail, on a larger scale, of FIG. 3.

FIG. **8*b* shows the universal stand configured for obtaining the spring characteristic shown in FIG. 8A**;

FIG. 9A is another axial spring characteristic for the lower horizontal roll; and FIG. 9B shows the universal stand configured for obtaining the spring characteristic shown in FIG. 9A.

DESCRIPTION OF THE PREFERRED EMBODIMENT

The universal stand schematically illustrated in FIG. 1 includes two horizontal rolls 1 and 2 and two vertical rolls 3 and 4. The roll supports for receiving the rolling forces exerted by the rolls are not shown. In the illustrated embodiment, the upper horizontal roll 1 as well as the lower horizontal roll 2 is each provided with an electromechanical long-stroke adjustment device 5 and 6, respectively, which are symbolically illustrated by double arrows and structurally correspond to units known in the art. This is also true for the electromechanical long-stroke adjustment devices 7 and 8 for the vertical rolls 3 and 4. The respective positions of the horizontal rolls 1 and 2 are monitored by distance indicators 9, 10 and are displayed at scales. In the same manner, the positions of the vertical rolls 3 and 4 are monitored by distance indicators 11 and 12.

The upper horizontal roll 1 is provided with two hydraulic short-stroke adjustment devices 13 and 14 and the vertical rolls are also provided with two hydraulic short-stroke adjustment devices 15 and 16. In addition, the upper horizontal roll is provided with an axially acting hydraulic short-stroke adjustment device 22. The position of the hydraulic short-stroke devices of the horizontal rolls are monitored in radial direction by means of the distance indicator 17. This monitoring is effected in the vertical rolls by means of the distance indicator 18. The distance indicator 21 serves to monitor the hydraulic short-stroke adjustment device 22 in axial direction of the horizontal roll. The rolling force exerted by the horizontal rolls 1, 2 on a rolled section is measured by rolling force indicators or pressure gauges 19. The rolling forces exerted by the vertical rolls 3 and 4 are determined by the pressure indicator 20. As not illustrated in detail, the measured values of all actual position indicators 17, 18, 21 and of the pressure gauges 19 for the horizontal rolling force and of the pressure indicators 20 of the rolling forces of the vertical rolls can be stored and called up from an electronic computer unit 26.

The upper and the lower horizontal rolls 1, 2 are mounted in the vertical center position MW of the rolling stand. The vertical rolls are mounted in the stand and horizontally on the same level. The upper horizontal roll is adjustable in axial direction by mean of the hydraulic short-stroke adjustment device 2. The lower horizontal roll 2 does not have its own adjustment guides in axial direction. For the exact determination of the vertical roll center, the mounted lower horizontal roll is moved with the vertical roll 4 of the drive side 23 against a reference edge 27 of the rolling mill stand. When a defined hydraulic measurement pressure is reached, the reached position is measured in the direction of the operator side 24 at the axial distance indicator 28 and a measurement point P1 is stored, as indicated in FIG. 2. Subsequently, the vertical rolls 4 of the drive side 23 is returned.

Subsequently, the lower horizontal roll 2 is moved with the vertical roll 3 of the operator side 24 from the reference edge 27 of the rolling mill stand in the direction of the drive side 23. When a defined hydraulic measurement pressure is reached, the reached position is measured in the direction of the drive side 23 at the axial distance indicator 29 and a measurement point P2 is stored, as also shown in FIG. 2.

The center position value MW of the lower horizontal roll is determined by computation, while the lower horizontal roll is held in the measured point P2. The center position value MW of the lower horizontal roll is determined by means of the following formula:

$$MW=(P2-P1):2 \text{ (mm)}$$

When the roll gap is set at zero, the lower horizontal roll 2 is moved by the distance of the center value MW from the measurement point P2 by means of vertical roll 4. When the position roll center MW is reached, the following positional values are set at zero in the computer unit 26.

Axial position of the upper horizontal roll 1

Axial position of the lower horizontal roll 2

Simultaneously with the movement of the lower horizontal roll 2, the upper horizontal roll has also been moved along. This requires unloading on both sides of the hydraulic cylinder of the short-stroke adjustment device 22 for the axial displacement of the upper horizontal roll 1.

After the roll center MW of the stand has been automatically determined and fixed as described above, the roll center must be determined. For this purpose, as described previously, the vertical rolls 3 and 4 must be mounted in the roll stand horizontally and at the same vertical level at the drive side 23 and on the operator side 24. The center of the vertical rolls is the reference plane for the roll gap center.

The vertical rolls 3 and 4 are moved up after positioning of the horizontal rolls 1 and 2 in the vertical center position MW of the stand and after setting at zero the axial actual position indicator 21 of both horizontal rolls. The two horizontal rolls 1 and 2 are moved together until roll kissing occurs and the hydraulic short-stroke adjustment device 13, 14 applies a defined roll body pressure of, for example, 100 KN. The position values of the actual position indicators are determined and stored in the computer unit 26 at the moment of roll kissing and when the roll body pressure is applied.

After setting the roll gaps at zero, a roll gap A of approximately 10 mm is adjusted as shown in FIG. 3. The two horizontal rolls are adjusted above the roll gap center MS to be determined later. The two vertical rolls 3, 4 are moved by means of the hydraulic short-stroke adjustment devices 15, 16 toward the lower horizontal roll 2 and the roll body pressure of each individual vertical roll is synchronously increased to, for example, 1000 KN.

After the clamping procedure of the lower horizontal roll 2, the upper horizontal roll 1 is moved axially by means of the hydraulic short-stroke adjustment device 22 from the center position MW to the vertical roll 4 of the drive side 23 and is subsequently moved to the vertical roll 3 of the operator side 24. The distances X1 and X2 are determined by means of the actual position indicator 21 for the upper horizontal roll 1.

The distance B of the lower horizontal roll 2 from the roll gap center MS is determined in accordance with the following formula:

$$B = \frac{X1 + X2}{4\, tg\, \alpha} - \frac{A}{2}$$

After the determination of the roll center MW and the roll gap center MS of the stand, the lower horizontal roll is moved to the computed roll gap center. Subsequently, the actual position indicator for the horizontal rolls and the actual position indicator for the vertical rolls are set at zero.

For positioning the upper and lower horizontal rolls to the roll gap "Zero" for the web thickness, an electromechanical long-stroke adjustment device 5, 6 with an adjustment accuracy of ±0.04 mm and a hydraulic short-stroke device 13, 14 for the upper horizontal roll with an adjustment accuracy of ±0.01 mm are used. The actual position indicator resolution used makes it possible to exactly adjust the roll gap to ±0.01 mm.

When the actual position indicator 17 for the horizontal rolls 1 and 2 is set at zero, the spring characteristic constant for the springiness of the stand in vertical direction is taken into consideration as is the constant determined by computation for the roll flattening of the upper and the lower horizontal rolls.

For setting at zero, the actual position indicators 18 of the vertical rolls 3, 4 in horizontal direction of the rolling mill stand, the vertical roll 4 of the drive side 23 and the vertical roll of the operator side 24 are simultaneously moved to the sides of the horizontal rolls. For positioning each vertical roll 3, 4 relative to the required roll gap for the flange thickness on the drive side 23 and the operator side 24, an electromechanical long-stroke ±0.04 mm and a hydraulic short-stroke adjustment device 15, 16 with an adjustment accuracy of ±0.01 mm are used. The actual position indicator resolution used makes it possible to accurately adjust each roll gap to ±0.01 mm. When the actual position indicator for the vertical roll is set at zero, the spring characteristic of the vertical roll in horizontal direction of the stand and in radial direction of the vertical rolls is taken into consideration. In addition, when setting a zero, the computed roll flattening of the vertical rolls is taken into consideration. The hydraulic short-stroke adjustment devices 13, 14 for the horizontal rolls 1, 2 and the hydraulic short-stroke adjustment devices 15, 16 for the vertical rolls 3, 4 are returned into the previously stored initial positions. Accordingly, the roll gap adjustment distances of the horizontal rolls and of the vertical rolls are related to the zero position of the hydraulic adjustment.

Particularly after the change of the horizontal and vertical rolls of the universal rolling mill stand to new section shapes in the rolling mill train, the spring characteristic constants of the universal stand must be newly determined in order to carry out a quick and reproducible pass adjustment of the universal stand without requiring a test run and a test bar. The determination of the spring characteristic constants is carried out by the following method steps:

Initially, the spring characteristic constants for the horizontal rolls are determined jointly, see FIGS. 5A and 5B. For this purpose, the electromechanical long-stroke adjustment device 5 and the hydraulic short-stroke adjustment device 13, 14 of the upper horizontal roll 1 and the electromechanical long-stroke adjustment device 6 of the lower horizontal roll 2 are actuated. The vertical rolls are in the opened position. For securing the centered adjustment movements of the upper horizontal roll and of the lower horizontal roll, the two drives for the electromechanical long-stroke adjustment devices are electrically synchronized. The hydraulic short-stroke adjustment devices 13, 14 are positioned in the initial position of the hydraulic cylinder and are held in this position during the adjustment movement.

Figure 6:
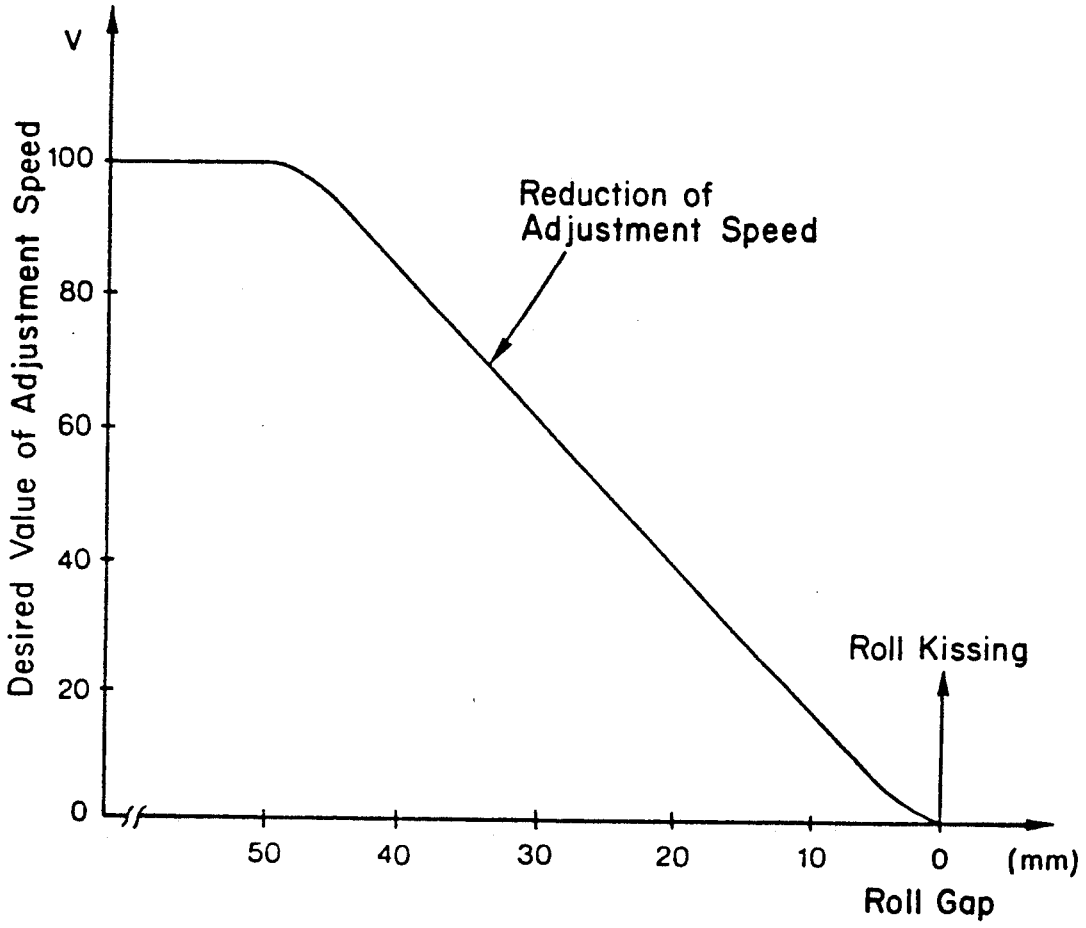
FIG. 6 is a curve of the adjustment speed in relation to the reduction of the roll gap.

The upper horizontal roll and the lower horizontal roll are moved toward each other electromechanically. The pressure gauges 19 arranged at the lower horizontal roll register a pressure increase, and the adjustment speed is reduced with increasing roll gap reduction in accordance with the speed pattern shown in FIG. 6. At the moment of contact of the horizontal rolls, the adjustment speed for both long-stroke adjustment devices reaches zero, i.e., the so-called roll kissing is reached.

The roll body pressure is increased to, for example, F=1000 KN by means of the hydraulic short-stroke adjustment device for the upper horizontal roll 1. The adjustment force 1000 KN corresponds in FIG. 5A to the initial value A1 in the spring characteristic. The adjustment distance of the piston is measured and stored. Simultaneously, this initial value A1 is set at zero.

The roll body pressure is further increased, for example, to F=3000 KN by means of the hydraulic short-stroke adjustment device for the upper horizontal roll. This corresponds to the value A2 in the spring characteristic according to FIG. 5A. The differential adjustment distance of the piston due to the additional pressure increase is measured and stored.

The roll body pressure is further increased by approximately 10% to, for example, F=3300 KN and is then reduced to 3000 KN by means of the hydraulic short-stroke adjustment device for the upper roll 1. This corresponds to the value B2 of the spring characteristic in FIG. 5A. The adjustment distance position of the piston is measured and stored. The hydraulic short-stroke adjustment device of the upper horizontal roll is further reduced to F=1000 KN. This corresponds to the value B1 in the spring characteristic of FIG. 5A.

For determining the average spring characteristic constants of the two horizontal rolls 1, 2, the points P1 and P2 have to be computed, wherein $P1=(B1-A1)/2$ and $P2=(B2-A2)/2$. The spring distance ($\Delta S$) results from the difference P2−P1 (mm); the differential pressure ($\Delta F$) results from the difference 3000 KN−1000 KN. Thus, the average spring characteristic constant is $\Delta F/\Delta S$ (KN/mm). The roll flattening which in the case of roll kissing is a function of the roll contact force, the roll diameters, the roll body length and of the roll material is not individually selectively measured, but is only determined by computation, is stored and is taken into consideration when determining the spring characteristic constant.

When determining the spring characteristic constants for the vertical rolls 3, 4 (FIG. 7), the electromechanical long-stroke adjustment devices 7, 8 and the hydraulic short-stroke adjustment devices 15, 16 are actuated. The horizontal rolls are moved together without pressure. The upper horizontal roll 1 is hydraulically unloaded on both sides at the short-stroke adjustment devices 22 for the axial movement.

The hydraulic short-stroke adjustment devices 15, 16 of the vertical rolls are positioned in the initial position of the hydraulic cylinder and are maintained in this position during the adjustment movement.

Until the vertical rolls contact the upper horizontal roll and/or the lower horizontal roll, the adjustment movement of the two vertical rolls is effected electromechanically, and not synchronized, and is carried out simultaneously for the drive side 23 and for the operator side 24 of the universal stand. In accordance with the speed pattern of FIG. 6, the adjustment speed is reduced with increasing roll gap reduction and becomes zero at the moment of contact with the upper horizontal and/or the lower horizontal roll, i.e., at the moment of roll kissing.

During the above-described procedure, the upper horizontal roll is pushed axially so that its edge is on the same level as that of the lower horizontal roll and the roll body pressure of the each individual vertical is increased in a pressure-synchronized manner to, for example, 1000 KN. The determination of the initial value A in the spring characteristic of FIG. 7A is carried out separately for the drive side and the operator side. This method makes it possible to determine the true spring characteristic constants for each vertical roll because the support forces over the horizontal rolls cancel each other and only the springiness values on the drive side and on the operator side are measured. For this purpose, the adjustment distance of the piston is measured and stored for each hydraulic short-stroke adjustment device 15, 16. Simultaneously, the initial values A1 are set at zero. The further determination of the spring characteristic constants for each vertical roll is carried out in accordance with the work steps as they are carried out for the horizontal rolls 1, 2 and as described with respect to FIGS. 5A and 5B and as illustrated by the spring characteristic of the horizontal rolls.

When the spring characteristic constants of the vertical rolls in the universal finishing stand are determined, the different angles of the horizontal rolls and of the vertical rolls must be compensated, for example, in sets of horizontal rolls for rolling sections whose flange width is greater than 500 mm. In this case, filler pieces or spacer pieces must be utilized when pressing the vertical rolls against the horizontal rolls. These spacer pieces are mounted during the roll change and are removed from the universal finishing stand after the vertical rolls are calibrated. When determining the spring characteristic constants, the flattened portion of the spacer pieces is taken into consideration in the computation together with the flattened portions of the vertical rolls.

The axial spring characteristic constant for the lower horizontal roll is determined in both directions of the vertical rolls, as shown in FIGS. 8A, 8B, 9A and 9B. For this purpose, the lower horizontal roll 2 has a symbolically illustrated adjustment distance position indicator 25 for the axial displacement of these rolls. The indicator 25 is arranged on the operator side 24 of the rolling mill stand.

For determining the axial spring characteristic constants for the lower horizontal roll, the electromechanical long-stroke adjustment devices 7, 8 and the hydraulic short-stroke adjustment devices 15, 16 of the two vertical rolls 3, 4 are used. The upper horizontal roll is hydraulically unloaded from both sides by the axially acting short-stroke adjustment devices 22.

During rolling, the lower horizontal roll 2 cannot be maintained in the preadjusted roll center and yields due to the differential pressure of the two vertical roll forces in both directions. For compensating the different angles between the vertical roll and the horizontal roll, for example, in the case of flange widths of greater than 500 mm, spacer pieces are used in the universal finishing stand prior to the pressure application. The flattened portion of the spacer pieces is taken into consideration in the computation for determining the spring characteristic constants. The hydraulic short-stroke adjustment devices of the vertical rolls are positioned in the initial position of the respective hydraulic cylinders and are maintained in this position during the adjustment movement.

The spring characteristic constants of the lower horizontal roll 2 in the direction of the operator side 24 is determined in accordance with FIGS. 8A and 8B as follows.

The vertical roll 4 on the drive side 23 is moved by the electromechanical long-stroke adjustment device 8 against the lower horizontal roll. During this procedure, the upper horizontal roll is merely taken along. The adjustment speed is reduced up to the moment of contact in accordance with the reduction of the roll gap, i.e., the adjustment speed is reduced to zero in accordance with FIG. 6 until the moment of roll kissing. At the moment of contact of the vertical roll 4 on the lower horizontal roll 2, a pressure increase is registered.

The roll body pressure is increased to, for example, F=1000 KN by means of the hydraulic short-stroke adjustment device 16 for the vertical roll 4 on the drive side 23. This rolling force corresponds to the initial value A1 of the spring characteristics to be determined. The adjustment distance value on the distance indicator 18 at the axial displacement is set at zero at 1000 KN. In accordance with the spring characteristic of FIG. 8A, the roll body pressure is further increased to, for example, F=3000 KN by means of the hydraulic short-stroke adjustment device 16 of the vertical roll on the drive side. This rolling force corresponds to the value A2 on the spring characteristic. The adjustment distance is measured through the distance indicator at the axial displacement and is stored. The roll body pressure of the vertical roll 4 is then further increased by 10% to, for example, F=3300 KN and is then reduced to 3000 KN. This rolling force corresponds to the value B2 on the spring characteristic of FIG. 8A. The adjustment distance position at the axial displacement is measured and stored. The roll body pressure is further reduced to 1000 KN at the hydraulic short-stroke adjustment device 16 of the vertical roll on the drive side. This rolling force corresponds to the value B1 on the spring characteristic of FIG. 8A. The adjustment distance position at the axial displacement is measured and stored. The average spring characteristic constant between the points P1 and P2 of FIG. 8 is computed in accordance with the algorithm which had previously been provided in the computation of the average spring characteristic constants for the horizontal rolls 1, 2.

The determination of the spring characteristic constants for the lower horizontal roll 2 in the direction of the drive side 23 in accordance with FIGS. 9A and 9B is carried out in the same manner as the determination of the spring characteristic constants of the lower horizontal roll in the direction of the operator side 24 in accordance with FIGS. 8A and 8B and is to be carried out by means of vertical roll 3 on the operator side 24, as schematically illustrated in FIG. 9B. The computation of the average spring characteristic constants between the points P1 and P2 in FIG. 9A is also carried out in accordance with the algorithm which had previously been provided for the computation of the average spring characteristic constants in FIG. 8A, i.e., for the horizontal roll.

The method and arrangement according to the present invention makes possible an automatic adjustment of the rolls of a universal stand together with an automatic setting at zero of the horizontal roll gap and the vertical roll gap while taking into consideration the determined actual spring characteristic constants. The automatic adjustment of the srolls of the universal stand can be carried out from an operator position. The above-described measures may not only be applied to the lower horizontal roll but also alternatively to the upper horizontal roll of the universal stand.

While a specific embodiment of the invention has been shown and described in detail to illustrate the application of the inventive principles, it will be understood that the invention may be embodied otherwise without departing from such principles.

We claim:

1. In a method for automatically aligning horizontal rolls and vertical rolls in a universal rolling mill stand after the stand has been changed to new types of sections in a rolling mill train, wherein the rolls are adjusted electromechanically and are pressurized hydraulically, the improvement comprising the simultaneous determination of the spring characteristic constants of the stand and the automatic alignment of the horizontal rolls and vertical rolls of the stand by jointly determining the radial spring characteristic for the horizontal rolls, separately determining the radial spring characteristic for each vertical roll and separately determining the axial spring characteristic of one of the horizontal rolls in accordance with one of two axial directions defined by the horizontal rolls, moving the rolls electromechanically toward each other until a moment of contact, wherein a contact pressure is established at the moment of contact and the speed of the electromechanical adjustments of the rolls toward each other is reduced with the increasing distance reduction and becomes zero at the moment of contact, and subsequently increasing the contact pressure to at least two pressure points and then relieving the pressure.

2. The method according to claim 1, comprising synchronizing the electromechanical adjustment of the horizontal rolls toward each other and with opened vertical rolls, and subsequently hydraulically applying the roll body pressure to one of the horizontal rolls.

3. The method according to claim 2, comprising moving the vertical rolls electromechanically against the sides of the horizontal rolls until the moment of contact, wherein the upper and lower horizontal rolls are moved together without pressure and the upper horizontal roll is unloaded with respect to axial movement, and subsequently hydraulically applying pressure in a synchronized manner to each vertical roll.

4. The method according to claim 3, comprising electromechanically moving one of the vertical rolls each from one side and the other side against a corresponding side of the lower horizontal roll until the moment of contact, wherein the horizontal rolls are moved toward each other without pressure and wherein subsequently pressure is applied hydraulically to each vertical roll.

5. The method according to claim 4, comprising placing a filling piece between the sides of the horizontal rolls and each vertical roll prior to applying hydraulic pressure to the vertical rolls.

6. The method according to claim 5, comprising measuring and storing adjustment distances of the rolls resulting from the hydraulic pressures applied to the rolls, and determining an average spring characteristic constant from the adjustment distances and the corresponding applied pressures.

* * * * *